United States Patent [19]

Mason

[11] 4,262,519

[45] Apr. 21, 1981

[54] VEHICLE FRAME ALIGNMENT APPARATUS

[75] Inventor: James H. Mason, Narrabeen, Australia

[73] Assignee: Applied Power Inc., Brookfield, Wis.

[21] Appl. No.: 961,430

[22] Filed: Nov. 16, 1978

[30] Foreign Application Priority Data

Oct. 10, 1978 [AU] Australia ..... PD6319

[51] Int. Cl.[3] ..... B21D 1/14

[52] U.S. Cl. ..... 72/457; 72/705

[58] Field of Search ..... 72/705, 457

[56] References Cited

U.S. PATENT DOCUMENTS

| | | | |
|---|---|---|---|
| 2,442,425 | 6/1948 | Merrill et al. | 72/705 X |
| 2,563,527 | 8/1951 | Gingrich et al. | 72/705 X |
| 2,717,020 | 9/1955 | Dobias | 72/705 X |
| 3,566,666 | 3/1971 | Berendt et al. | 72/705 X |
| 3,626,747 | 12/1971 | Rouis | 72/705 X |
| 3,776,022 | 12/1973 | Lionello | 72/705 X |
| 3,835,692 | 9/1974 | Hoffman | 72/705 X |
| 3,835,693 | 9/1974 | Majersky | 72/705 X |
| 4,151,737 | 5/1979 | Specktor | 72/705 X |

FOREIGN PATENT DOCUMENTS

| | | | |
|---|---|---|---|
| 249933 | 2/1964 | Australia | 72/705 |

*Primary Examiner*—Lowell A. Larson

[57] ABSTRACT

A vehicle frame alignment apparatus comprising a pair of substantially parallel tracks upon which a vehicle may rest, at least one transversely extending beam suspended beneath the tracks, the beam being longer than the spacing between the tracks and having an upright pillar at each end thereof, the pillars being respectively on opposite sides of the pair of tracks and provided with anchorage means for attachment of straining members for applying a plurality of variously directed loads to the vehicle, the beam being suspended beneath the tracks by a pair of suspension units, each suspension unit comprising a top and bottom carriage mutually interconnected by a substantially vertical shaft so as to be relatively rotatable about the axis of the shaft, each of the tracks having fixedly associated and extending substantially parallel therewith a pair of longitudinally extending track rails spaced one from the other along which top carriage rides, the transverse beam having fixedly associated and extending substantially parallel therewith a pair of longitudinally extending beam rails spaced one from the other and bearing upon the bottom carriage over which the beam rails ride, the arrangement thereby permitting the beam to move transversely, longitudinally and rotationally with respect to the tracks, and means for locking the beam with respect to the tracks.

13 Claims, 9 Drawing Figures

5
20
19
4
20
8
9
18
10
19
1

19
22
21
4
1
7
6
4
9
8
19
4
6
9
8
1
7
19
4
32
31
5

VEHICLE FRAME ALIGNMENT APPARATUS

In the repair of automotive bodywork the damaged vehicle must be firmly supported and carefully directed pushing or pulling loads applied in order to effect the necessary repairs. With small vehicles these operations can be performed by the use of relatively simple equipment but this known equipment is incapable of accommodating larger vehicles such as buses or trucks.

It is an object of the present invention to provide an automotive body alignment frame which is particularly well adapted for use with large vehicles.

According to the invention there is provided a vehicle frame alignment apparatus comprising a pair of substantially parallel tracks upon which a vehicle may rest, at least one transversely extending beam suspended beneath said tracks, said beam being longer than the spacing between said tracks and having an upright pillar at each end thereof, said pillars being respectively on opposite sides of said pair of tracks and provided with anchorage means for attachment of straining members for applying a plurality of variously directed loads to said vehicle, said beam being suspended beneath said tracks by a pair of suspension units, each suspension unit comprising a top and bottom carriage mutually interconnected by a substantially vertical shaft so as to be relatively rotatable about the axis of said shaft, each of said tracks being fixedly associated and extending substantially parallel therewith a pair of longitudinally extending track rails spaced one from the other along which top carriage rides, said transverse beam having fixedly associated and extending substantially parallel therewith a pair of longitudinally extending beam rails spaced one from the other and bearing upon said bottom carriage over which said beam rails ride, the arrangement thereby permitting said beam to move transversely, longitudinally and rotationally with respect to said tracks, and means for locking said beam with respect to said tracks.

A preferred embodiment of the invention will now be described, by way of example only, with reference to the accompanying drawings in which.

Figure 1:
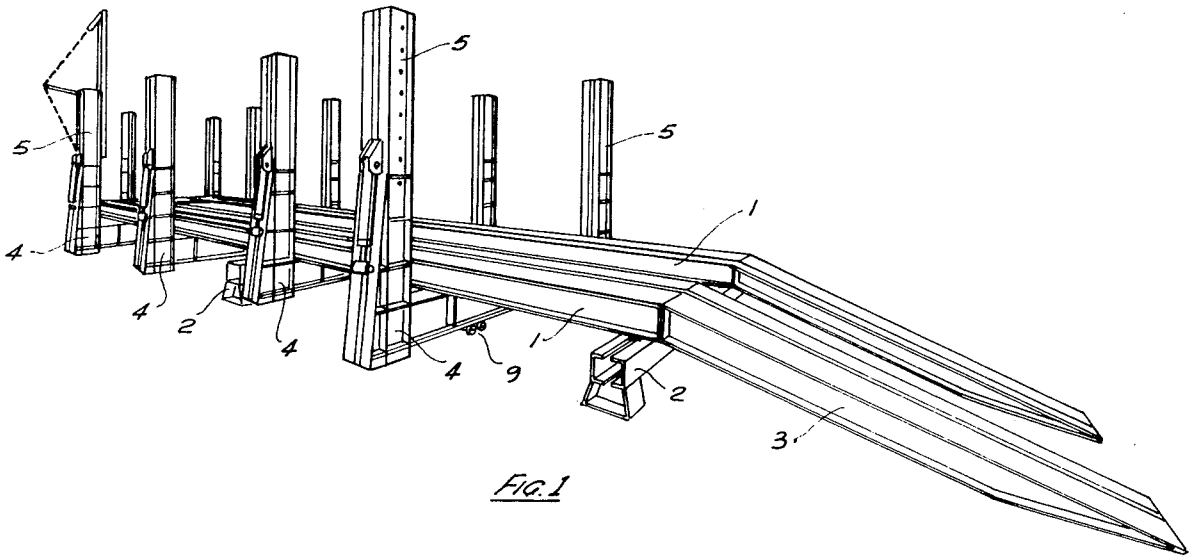
FIG. 1 is a perspective view of an alignment frame according to the invention.

Referring to the drawings, the frame includes a pair of spaced tracks 1 supported on cross-beams 2 and respectively provided with inclined ramp 3 to permit a vehicle to mount the tracks and rest thereon. Spaced along the frame and suspended beneath the tracks are a plurality of transverse beams 4 each provided with a vertical pillar 5 at its opposite ends to form a generally U-shaped structure from which loads can be applied to the vehicle.

Figures 3, 4:
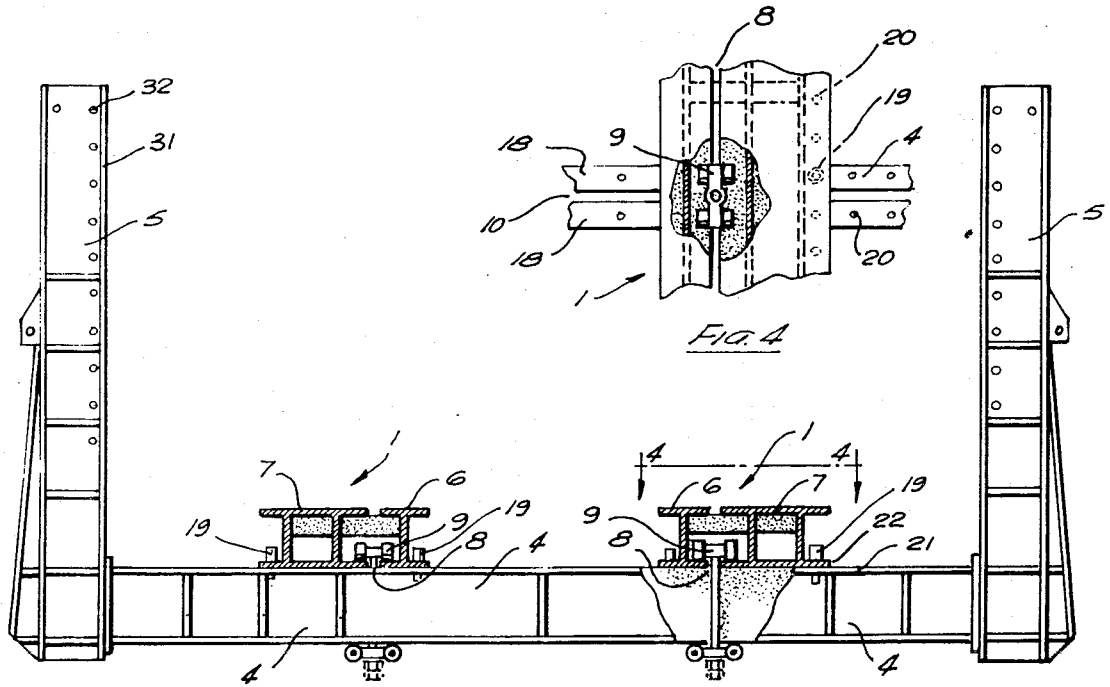
FIG. 3 is a section taken on line 3—3 of FIG. 2.
FIG. 4 is a cut-away view taken on line 4—4 of FIG. 3.
Figure 8:
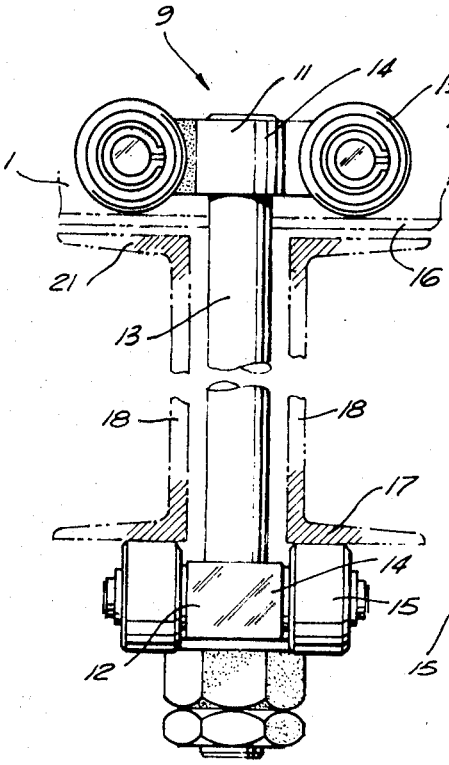
FIG. 8 is a section taken on line 8—8 of FIG. 2.
Figure 9:
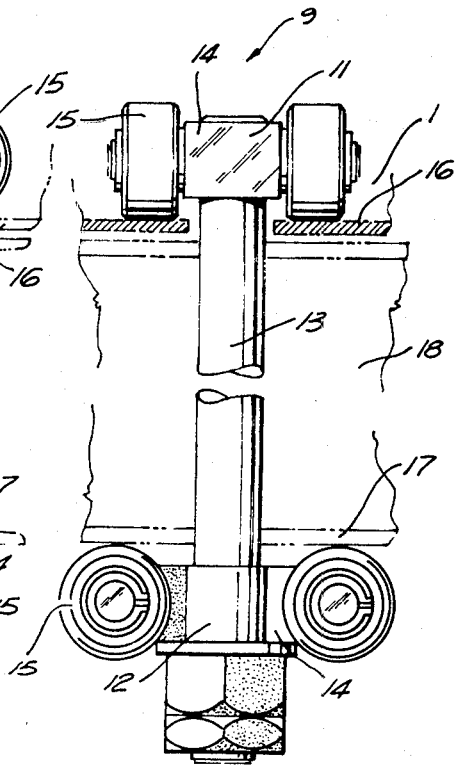
FIG. 9 is a section taken on line 9—9 of FIG. 2.

As best shown in FIGS. 3, 8 and 9, each of the tracks 1 is in the form of a composite beam having two parts 6 and 7 spaced a short distance apart leaving a longitudinally extending gap 8 between them. Two opposing flanges 16 adjacent the gap in each track define rails which support a plurality of roller mounted suspension units 9 which in turn support the transverse beams 4, two suspension units being provided for each beam. Like the two tracks 1, each transverse beam is composite in form, being constructed of two U-shaped channel members 18 arranged back to back so as to leave a gap 10 between them.

Figure 7:
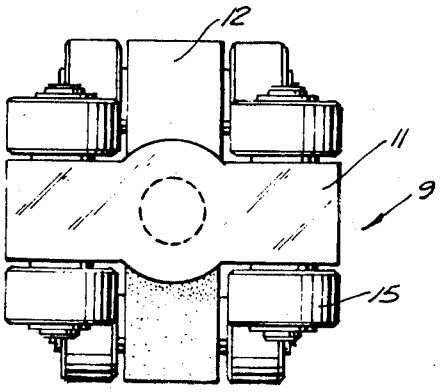
FIG. 7 is a plan view of a carriage unit shown in FIG. 4.

As best shown in FIGS. 7, 8 and 9, each suspension unit 9 includes substantially identical top and bottom carriages 11 and 12 respectively interconnected by a vertical shaft 13 so that the bottom carriage can rotate relative to the top one. Each carriage has a body portion 14 from which extends two pairs of rollers 15, the top rollers engaging the flanges 16 on the tracks 1 while the bottom rollers engage the underside flanges 17 of the transverse beams 4, with the shaft 13 extending through the gaps 8 and 10 in the tracks and beams respectively. It will be apparent, therefore, that the transverse beams can be moved not only longitudinally and transversely relative to the tracks but they can also be pivoted in a horizontal plane below tracks 1 about any desired vertical axis. The beams can be locked to the tracks in any selected position by inserting locking pins 19 through registrable pairs of holes 20 formed in the upper flanges 21 of the transverse beams and the adjacent lower flanges 22 of the tracks 1.

Figure 2:
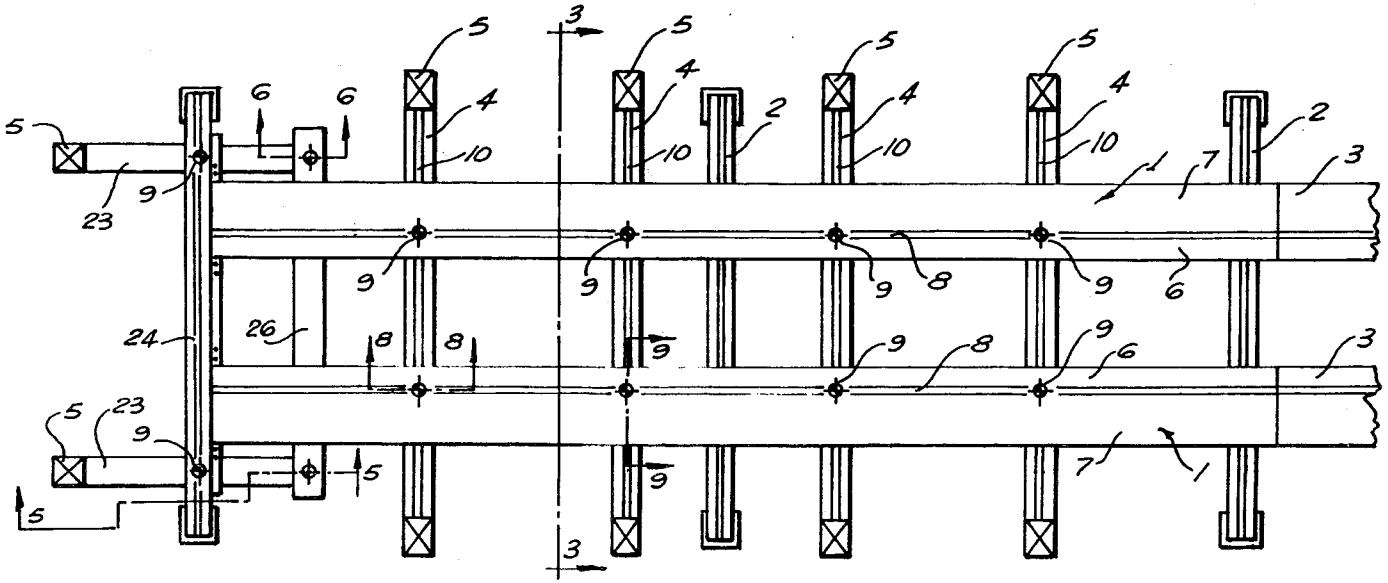
FIG. 2 is a schematic plan view of the alignment frame shown in FIG. 1.
Figure 6:
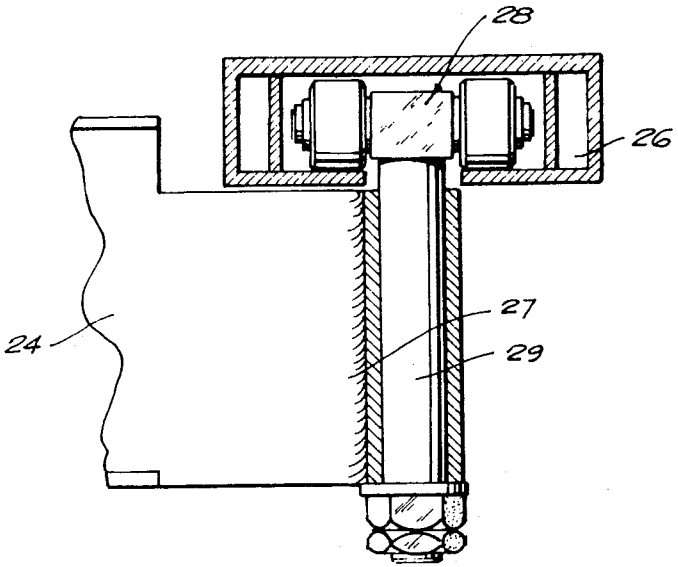
FIG. 6 is a section taken on line 6—6 of FIG. 2.
Figure 5:
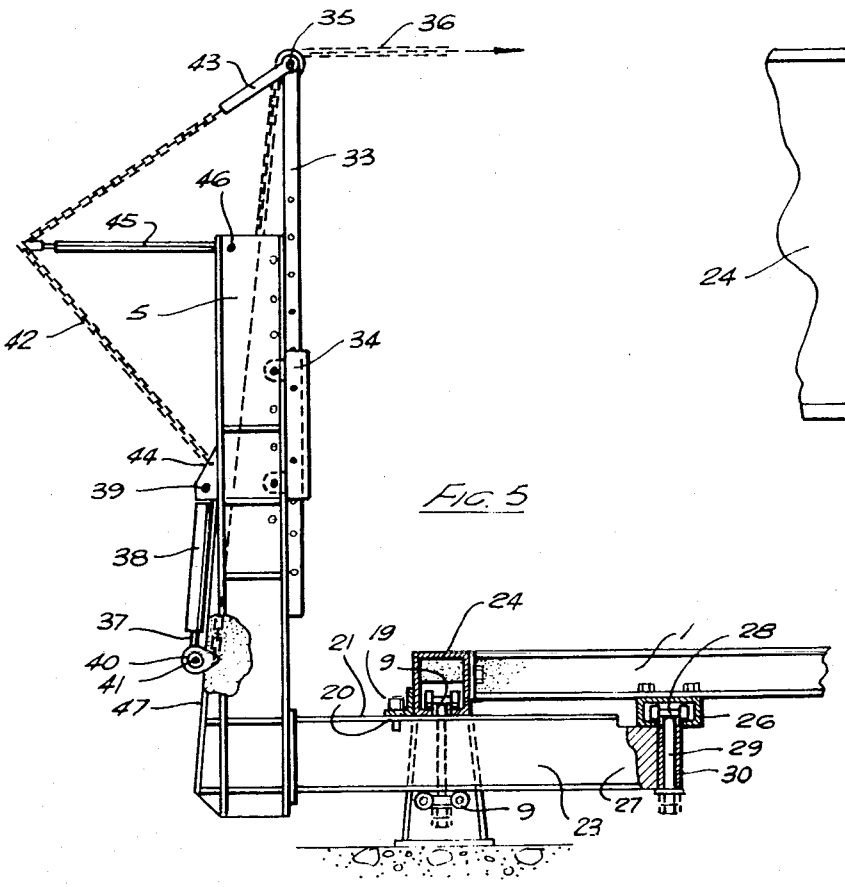
FIG. 5 is a section taken on line 5—5 of FIG. 2.

The frame is provided at its forward end with a pair of end beams 23 as best shown in FIGS. 2, 5 and 6. Each end beam 23 includes a vertical pillar 5 substantially identical with those on each transverse beam, the pillar 5 being connected to the distal end of the end beam 23. Each end beam 23 is similar in construction to the transverse beams and is slung beneath a first channel sectioned front cross beam 24 by a suspension unit 9 which functions in the same manner as those units supporting the transverse beams. A second channel sectioned cross beam 26 is secured beneath the tracks at a position spaced back from the first cross beam 24. The proximal end 27 of the end beam 23 is slung beneath this second cross beam 26 by a suspension unit in which the vertical supporting shaft is in the form of a pivot mounting pin 29 by which the proximal end 27 is secured to its top carriage 28 so as to be rotatable relative thereto about a substantially vertical axis. This arrangement permits each end beam to slide transversely of the tracks and rotate about the pivot mounting pin 29 so that the end beam vertical pillars 5 can be swung outwardly of the tracks or otherwise arranged at an acute angle to them as the top carriage of suspension unit 9 slides along the front cross-beam 24 while the carriage 28 is free to move along beam 26. Like the transverse beams, the end beams can be locked to the frame in any desired location by inserting locking pins 19 into registering holes 20 in flanges on the end beam and cross beam 24. These end beams can thereby be positioned and secured so as to permit the application of diagonal forces to a vehicle resting on the tracks.

In order to facilitate the application of loads to the vehicle, the vertical pillars 5 are provided with formations such as flanges 31 and holes 32 for supporting straining equipment such as that illustrated in FIG. 5. In this particular arrangement, a post 33 is adjustably telescopically mounted to the pillar 5 by a sleeve 34. The distal end of the post is provided with a pulley 35 by which a chain 36 can pass from the vehicle to the ram 37 of an hydraulic cylinder 38 pivotally mounted to the pillar at 39. The pillars are each formed in two parts, spaced to define a gap through which the chain can pass. The chain 36 is attached to the ram 37 by a block 40 provided with rollers 41 which move along an inclined track 47 as the ram extends. Additional support is provided for the post 33 by a chain bracing assembly in which an auxilliary chain 42 extending from a yoke mounting 43 at the end of the post to an attachment slot 44 on the pillar is tensioned by an adjustable rod 45 hingedly mounted to the pillar at 46.

Although the invention has been described with reference to a specific example, it will be appreciated by those skilled in the art that the invention may be embodied in many other forms.

I claim:

1. A vehicle frame alignment apparatus comprising a pair of substantially parallel tracks upon which a vehicle may rest, at least one transversely extending beam suspended beneath said tracks, said beam being longer than the spacing between said tracks and having an upright pillar at each end thereof, said pillars being respectively on opposite sides of said pair of tracks and provided with anchorage means for attachment of straining members for applying a plurality of variously directed loads to said vehicle, said beam being suspended beneath said tracks by a pair of suspension units, each suspension unit comprising a top and bottom carriage each having rollers and mutually interconnected by a substantially vertical shaft so as to be relatively rotatable about the axis of said shaft, each of said tracks having fixedly associated and extending substantially parallel therewith a pair of longitudinally extending track rails spaced one from the other along which the rollers of said top carriage ride, said transverse beam having fixedly associated and extending substantially parallel therewith a pair of longitudinally extending beam rails spaced one from the other and bearing upon the rollers of said bottom carriage over which said beam rails ride, the rollers of said top carriage supporting said beam for movement longitudinally of said tracks, the rollers of said bottom carriage supporting said beam for transverse movement relative to said tracks, the rotational mounting of said carriages permitting the beam to pivot in a generally horizontal plane as the opposite ends of said beam are moved to different relative positions along said tracks, and locking means for locking said beams in each of said positions.

2. A vehicle alignment apparatus as claimed in claim 1 further including at least one end beam, said end beam having an upright pillar at its distal end, said pillar being provided with anchorage means for attachment of straining members for applying a plurality of variously directed loads to said vehicle, first and second cross beams fixed with respect to said tracks and extending transversely there across, said first cross beam being located at one end of said tracks and said second cross beam being spaced back from said first cross beam to underly said tracks, said end beam being suspended beneath said cross beams by first and second suspension units, each suspension unit including a top carriage, said cross beams each defining a pair of longitudinally extending beam rails spaced one from the other along which said top carriages respectively ride, said first suspension unit further including a bottom carriage connected to its companion top carriage by a substantially vertical shaft so as to be relatively rotatable about the axis of said shaft, said end beam having fixedly associated and extending substantially parallel therewith a pair of longitudinally extending end beam rails spaced one from the other and bearing upon said bottom carriage over which said end beam rails ride, said second suspension unit further including a pivot mounting pin securing the proximal end of said end beam to its top carriage so as to be rotatable relative thereto about a substantially vertical axis, the arrangement thereby permitting said end beam to move transversely and rotationally with respect to said tracks, and means for locking said end beam with respect to said tracks.

3. A vehicle frame alignment apparatus as claimed in claim 1 or claim 2 wherein at least one of said pillars is provided with a telescopically adjustable vertical post, the distal end of which is provided with a pulley for receiving a chain whereby straining loads may be applied to said vehicle.

4. A vehicle frame alignment apparatus as claimed in claim 1 or claim 2 wherein at least one of said pillars is provided with an inclined outer surface which tapers inwardly with increased height from its base, said pillar further including a chain attachment block and an hydraulic cylinder and ram assembly secured to said pillar and coupled to said chain attachment block for moving said block downwardly and outwardly along said inclined surface upon actuation of said assembly whereby forces transmitted to a chain coupled to said block are transferred to said surface.

5. A vehicle frame alignment apparatus as claimed in claim 1 or claim 2 wherein said transversely extending beam is formed at least in part from two channel members each having a web and two substantially parallel and horizontal flanges, said webs being arranged back to back and spaced one from the other to leave a longitudinally extending gap therebetween, the downwardly directed surface of the lowermost flanges defining said beam rails.

6. A vehicle frame alignment apparatus as claimed in claim 2 wherein said end beam is formed at least in part from two channel members each having a web and two substantially parallel and horizontal flanges, said webs being arranged back to back and spaced one from the other to leave a longitudinally extending gap therebetween, the downwardly directed surface of the lowermost flanges defining said end beam rails.

7. A vehicle frame alignment apparatus as claimed in claim 6 wherein said first cross beam is provided with at least one substantially horizontal flange extending transversely relative to said tracks and closely adjacent the uppermost flanges of said end beam, said means for locking said end beam with respect to said tracks comprising a plurality of mutually registrable holes respectively formed in said transversely extending flange and said adjacent uppermost flanges and pin means able to enter a mutually registered pair of said holes.

8. A vehicle frame alignment apparatus as claimed in claim 1 wherein said pillars are formed in two parts spaced to define a gap therebetween.

9. A vehicle frame alignment apparatus as claimed in claim 8 wherein said tracks are provided with at least one substantially horizontal, longitudinally extending flange closely adjacent the uppermost flanges of said transversely extending beam, said means for locking said beam with respect to said tracks comprising a plurality of mutually registrable holes respectively formed in said longitudinally extending flange and said adjacent uppermost flanges and pin means able to enter a mutually registered pair of said holes.

10. A vehicle frame alignment apparatus comprising a pair of substantially parallel track means adapted to support a vehicle, at least one transverse beam means disposed beneath said track means, said beam means being longer than the spacing between said track means and having a force producing means disposed adjacent at least one end thereof for applying forces to said vehicle, said beam means being suspended beneath said track means by first and second suspension means, each said suspension means comprising connecting means and first and second vertically spaced apart roller means mounted on said connecting means, at least one of said first and second roller means being mounted on said suspension means for rotation about a substantially vertical axis, each of said track means having associated therewith a first track which extends longitudinally and is spaced from the track on the other track means, each of said first roller means being disposed on one of said first tracks, said transverse beam means having surface means defining a second track extending substantially parallel therewith, said second track bearing upon the second roller means over which said beam means is mounted for movement on said second roller means, said first roller means mounting said beam means for movement longitudinally of said track means, said second roller means supporting said beam means for transverse movement relative to said track means, the rotational mounting of at least one of said first and second roller means on said connecting means permitting the beam means to pivot in a generally horizontal plane as the opposite ends of said beam means are moved to different relative positions along said first tracks, and means for locking said beam means in said relative positions.

11. A vehicle frame alignment apparatus as claimed in claim 10 wherein said force producing means includes a vertical post means, anchor means mounted on said post means and constructed and arranged for receiving a flexible force transmitting means, structural means on said post means for defining an inclined outer surface which tapers inwardly and upwardly, pulley means mounted on said post means, and a hydraulic cylinder mounted on said post means, ram means extending from said cylinder and having an engagement means thereon, said engagement means being movable downwardly and outwardly along said inclined surface upon actuation of said cylinder to exert a force on said vehicle through said flexible force transmitting means affixed to said anchor means and extending around said engagement means and said pulley and to said vehicle.

12. The vehicle frame alignment apparatus set forth in claim 10 wherein said track means has an upper surface upon which said vehicle rests, said first track being formed on said track means and below and spaced from the upper surface thereof whereby said first roller means may traverse said track means without engaging said vehicle.

13. The vehicle frame alignment apparatus set forth in claim 12 wherein said connecting means includes a generally vertically extending shaft, each said first track includes a first pair tracks which are parallel and spaced apart, each said first roller means including spaced rollers mounted respectively on one of the tracks of said first pair, said second track comprising a second pair of tracks formed on said beam means, each said second roller means including spaced rollers mounted respectively below one of the tracks of said second pair, said shaft extending downwardly between said pairs of tracks.

* * * * *